United States Patent [19]

Rossum

[11] Patent Number: 4,987,600

[45] Date of Patent: Jan. 22, 1991

[54] DIGITAL SAMPLING INSTRUMENT

[75] Inventor: David P. Rossum, LaSelva Beach, Calif.

[73] Assignee: E-Mu Systems, Inc., Scotts Valley, Calif.

[21] Appl. No.: 390,436

[22] Filed: Aug. 3, 1989

Related U.S. Application Data

[63] Continuation of Ser. No. 874,250, Jun. 13, 1986, abandoned.

[51] Int. Cl.[5] ..... G10H 7/00

[52] U.S. Cl. ..... 381/118; 84/603; 84/621

[58] Field of Search ..... 84/1.28, 1.03, 601, 84/602, 603, 604, 605, 606, 607, 621; 381/31, 118

[56] References Cited

U.S. PATENT DOCUMENTS

| | | | |
|---|---|---|---|
| 3,982,460 | 9/1976 | Obayashi et al. | 84/1.01 |
| 4,085,644 | 4/1978 | Deutsch et al. | 84/1.01 |
| 4,244,264 | 1/1981 | Fellot | 84/345 |
| 4,471,681 | 9/1984 | Nishimoto | 84/1.23 |
| 4,538,496 | 9/1985 | Hanzawa | 84/1.26 |
| 4,748,577 | 5/1988 | Marchant | 364/722 |

*Primary Examiner*—Forester W. Isen

*Attorney, Agent, or Firm*—Flehr, Hohbach, Test, Albritton & Herbert

[57] ABSTRACT

A digital sampling instrument is disclosed. The instrument provides the capability of accessing and outputting stored digital data within a single clock cycle. The instrument also provides improved volume scaling for sound generation and further eliminates redundant loading of a particular sound into a sound memory.

1 Claim, 6 Drawing Sheets

DIGITAL SAMPLING INSTRUMENT

This is a continuation of application Ser. No. 874,250 filed June 13, 1986, now abandoned.

BACKGROUND OF THE INVENTION

The present invention relates to a digital sampling instrument and more particularly to a digital sampling keyboard instrument.

Digital sampling keyboard instruments are known in the prior art to provide accurate generation of virtually any sound, such as piano, (violin or any other type of sound, for that matter). Typically, an analog audio sound is digitized and stored in a sound memory and then played out by a user, as desired. With prior art instruments, in order to change the pitch of a particular sound (such as increasing the pitch of a violin sound) the prior art has, in some approaches, changed the spacing interval between digital samples. For example, in order to increase the pitch of a particular sound, the sampling rate is changed from, for example, 50 microseconds to 40 microseconds. This approach, while generally adequate, requires expensive asynchronous hardware.

Another approach is to effectively "skip" or "duplicate" particular digital samples, which effectively increases the pitch, but also generates unwanted distortion.

Another approach is to oversample the digital samples, which in effect divides up a pitch period (such as a pitch period of 50 microseconds) into a smaller number of subperiods. For example, a pitch period of, say, 20 subperiods can be sampled within 19 periods, thus effectively increasing the pitch of a particular sound, while reducing or limiting the distortion (which can still be present).

As is also known in the prior art, the digital samples stored in a sound memory are generally stored as PCM data. In order to provide suitable fidelity in the actual audio sound generation, prior art approaches can introduce an unwanted or undesirable "clicking" sound. This is because of what can happen when PCM encoding an audio sound (for example, an audio sine wave). When there is a sudden change of the volume (such as by a step function), this can introduce an undesired clicking noise into the volume scaling, which again affects the fidelity of the sound generation.

SUMMARY OF THE INVENTION

It is an object of the present invention to provide an improved digital sampling instrument.

It is another object of the present invention to provide a digital sampling instrument which has improved fidelity of the audio sound to be generated.

Briefly, the present invention provides a digital sampling instrument operating in successive clock cycles and includes memory means for storing digital sound data in a plurality of accessible locations in the memory means. The instrument also includes means for accessing the digital sound data within a single clock cycle which is one-fourth as long as a memory cycle, and means for outputting the accessed digital data to, for example, a digital to analog converter means for generating an audio sound within the single clock cycle. This provides a fast and accurate generation of the desired audio sound.

According to another aspect of the present invention, the instrument includes means for logarithmically encoding successive differences of digital data samples representative of a particular sound and means for accumulating differences between successive ones of the digital data samples to form PCM data. The instrument also includes means for adding the logarithmically encoded differential data to create a volume scaled data sample, which can be suitably decoded and converted to an audio format for accurate generation of a desired sound.

According to a further aspect of the present invention, the instrument includes a first non-volatile memory means for storing a plurality of identification numbers where each of the numbers is unique to one another. The instrument also includes second memory means for storing a plurality of different digital sound data samples where each of the different sound data samples is representative of a particular sound.

The instrument further includes control means for assigning one of the unique identification numbers with a particular one of the different sound data samples (to form "tagged" data samples) and means for storing the tagged sound data samples in the second memory means. The instrument further includes means for comparing the tagged sound data with additional sound data to determine whether the additional sound data should be stored in the second memory means. This aspect of the present invention eliminates the requirement of storing redundant data in the second memory means, which avoids long processing time.

Other objects, features and advantages of the present invention will become apparent from the following detailed description when taken in conjunction with the accompanying drawings.

DETAILED DESCRIPTION OF THE DRAWINGS

Figure 1:
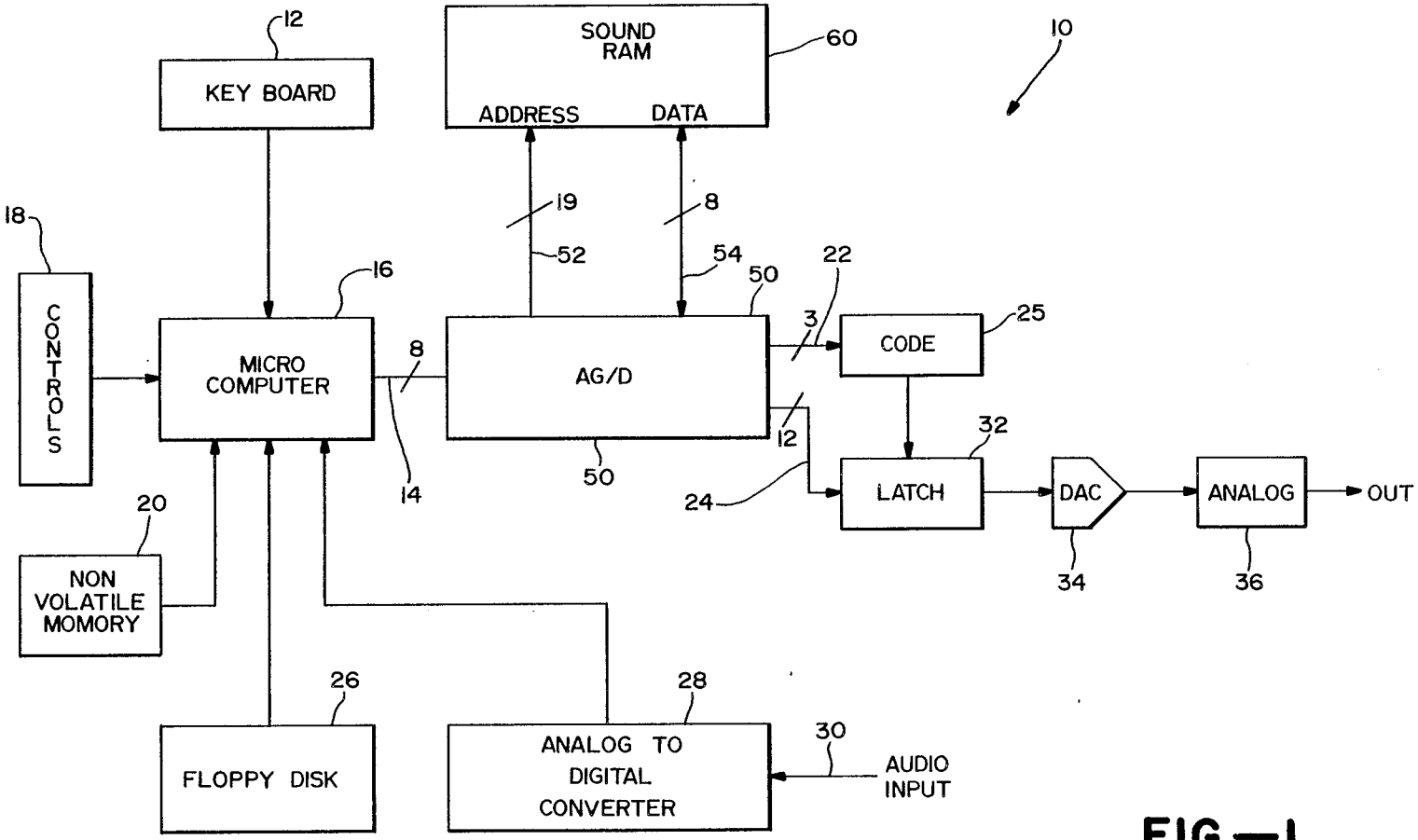
FIG. 1 depicts a block diagram of a digital sampling instrument according to the present invention.

Referring now to FIG. 1, a digital sampling keyboard instrument 10 according to the present invention is depicted in block diagram form. In FIG. 1, instrument 10 includes a keyboard 12 connected to a microcomputer or microprocessor 16. A user of the instrument 10 will depress a key on keyboard 12 to generated desired sounds such as piano, violin (or any other sound). Microcomputer 16 is also connected to a control logic circuit 18 which provides necessary operation control signals in a known fashion. The instrument 10 also includes a non-volatile memory 20 and a floppy disk 26 connected to microcomputer 16.

In order for a user to provide an audio input to the instrument 10, there is included an audio input bus 30 connected to an analog to digital (A/D) converter 28, which in turn is connected to microcomputer 16. An audio input is converted to a digital format by A/D converter 28 for input to microcomputer 16 for storage, as necessary, on a floppy disk 26.

Also connected to microcomputer 16 is an Address Generator and Decode Circuit (AG/D) 50 via bus 14. AG/D circuit 50 incorporates aspects of the present invention which will be described in more detail below.

In FIG. 1, AG/D circuit 50 is connected to a sound RAM 60 which contains any desired digital sound data. AG/D circuit 50 controls accessing or addressing of the sound RAM 60 via, in a preferred embodiment, 19-bit bus 52. AG/D circuit 50 communicates bidirectionally with sound RAM 60 to transmit and receive sound data via bidirectional 8-bit bus 54.

Outputs from AG/D circuit 50 include a 3-bit control bus 22, which provides appropriate channel identification for up to eight channels (in a preferred embodiment). 8-bit bus 22 communicates with a series of decoder circuits such as decoder 25, to provide appropriate enabling signals of a desired analog audio output to a latch 32, digital to analog converter (DAC) 34 and an analog output device 36 (which typically could be a filter).

AG/D circuit 50 also provides an output on 12-bit linear data bus 24 which is input to a desired latch 32. The linear digital data is converted to an analog format via DAC 34 for connection to the suitable analog device 36, as previously described.

In operation, when a user enters a desired sound to be audibly generated via keyboard 12, the microcomputer accesses desired sound data (if stored in floppy disk 26) for storage in sound RAM 60. Microcomputer 16 communicates with the non-volatile memory 20 to keep track of which sounds should be stored in sound RAM 60.

According to one aspect of the present invention, the instrument 10 depicted in FIG. 1 can determine if a sound must be loaded from floppy disk 26 to sound RAM 60 or, in the alternative, whether it is redundant to do so. This aspect will now be described with a general overview with respect to the operation of the instrument 10.

Because floppy disk access time is substantial, it is desirable to avoid unnecessary access of the floppy disk 26, if possible. The present invention provides a capability which avoids this undesirable limitation.

In FIG. 1, by using non-volatile memory 20 in conjunction with the microcomputer 16, a unique data sample representative of a particular sound is "tagged" with a unique identification number or code. With the unique identification number, a sound is loaded into floppy disk 26 by microcomputer 16. The desired sound stored in floppy disk 26 then is compared with any potential corresponding sound in sound RAM 60. If the identifications codes are identical, it is determined by microcomputer 16 that it is unnecessary to load data from floppy disk 26 into sound RAM 60. This avoids the loading of redundant data.

In order to clarify this aspect of the present invention, a specific example of this feature will now be described in detail.

Assume a user of the instrument 10 want to accompany himself with a piano sound and a set of violin strings. The user puts a sample of a piano into the instrument 10 (via audio input bus 30 to analog to digital converter 28 to microcomputer 16). In turn, microcomputer 16 stores the piano sound in floppy disk 26. Assume that the user is #100 and the non-volatile memory indicates that this is the tenth new sound this machine has ever stored to floppy disk. Then the sample sound of the piano is #10. The microcomputer will, for purposes of explanation, tag that sound as 100/10 to floppy disk 26 and increment the non-volatile memory to show the next floppy storage will be #11.

Next, the user might want to record a violin sound (through audio input bus 30 to analog to digital converter 28 to microcomputer 16). As indicated above, the identification tag from non-volatile memory 20 is #11, and microcomputer tags the violin sound as 100/11 into floppy disk 26.

Finally, assume further that the user obtains his piano sample from a friend, together with a sample of a flute sound. The friend's identification tag could be, for purposes of description, #101.

The user then turns on the instrument 10 of FIG. 1 (and assume the memory 60 is empty). The user inputs the piano and string sounds through microcomputer 16 to floppy disk 26. The desired sounds are tagged with the appropriate identification code, as indicated above, and microcomputer 16 controls the accessing of the desired sounds from floppy disk 26 to sound RAM 60.

Suppose now the user wants to change the desired sounds from piano and strings to piano and flute. If the user has a second floppy disk with the original piano sound, together with the desired flute sound, traditionally the prior art approach would be to reload the piano sound together with the new flute sound. However, according to the present invention, the desired piano sound is already stored in sound RAM 60 and hence need not be loaded again. The unique identification code for the particular sound will be provided by non-volatile memory 20 and will be tagged with each particular sound. Microcomputer 16 will perform a comparison of the identification codes for sound stored in floppy disk 26.

In the above example, the piano sound appearing on the second floppy disk 26 will be identified as the same sound already stored in sound RAM 60. Hence, if a user wants to change from piano and violin to piano and flute sounds, by utilizing the foregoing aspect of the present invention, the particular piano sound need not be redundantly loaded into sound RAM 60. This saves considerable time in operation.

Figure 2:
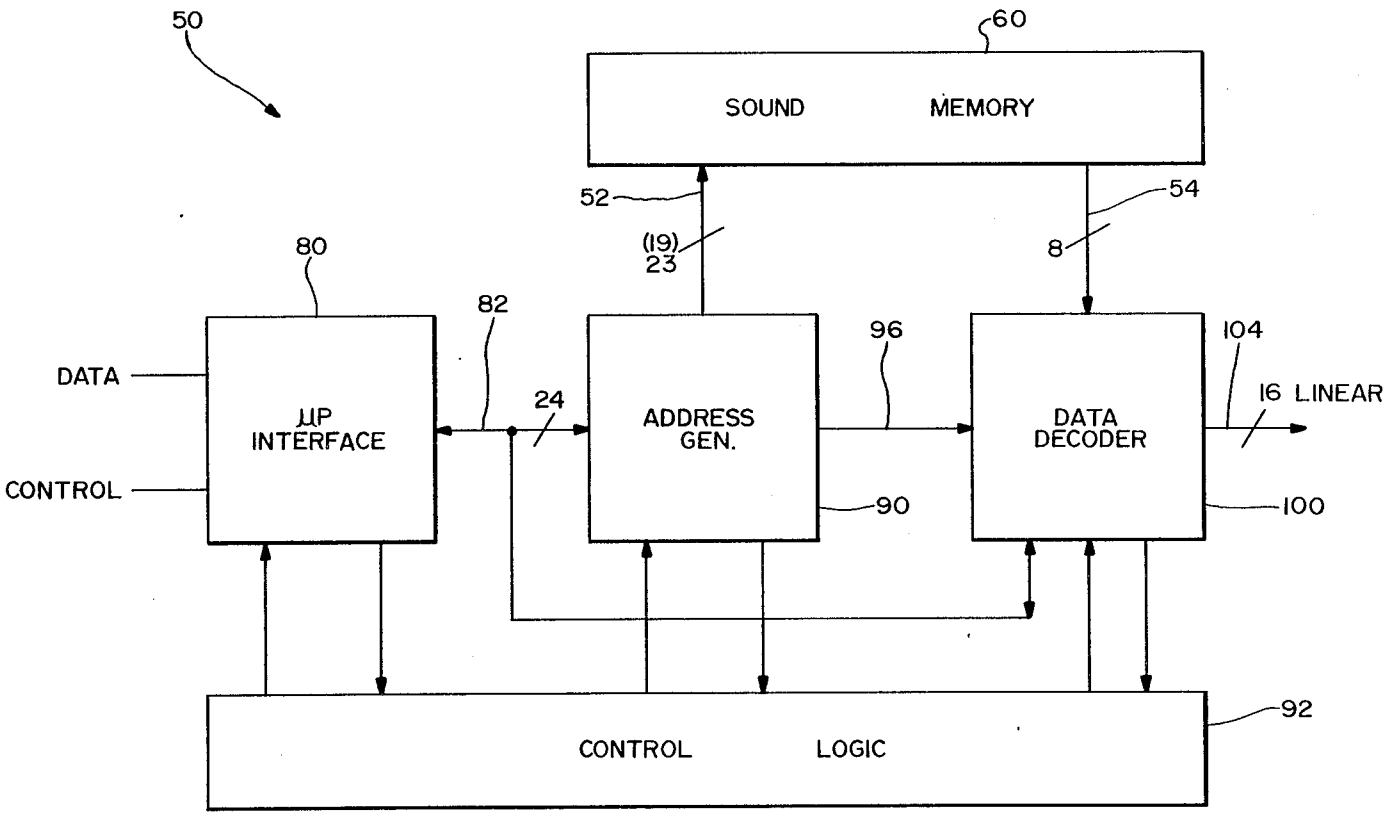
FIG. 2 depicts a block diagram of an address generator/data decode (AG/D) circuit, which forms a portion of the invention depicted in FIG. 1.

Referring now to FIG. 2, a block diagram of the address generator/data decoder logic circuit 50 according to the present invention is depicted.

The logic circuit 50 includes a microprocessor interface 80 which receives 8-bit data and 3-bit control data from the microprocessor 16 of FIG. 1. The purpose of microprocessor interface 80 is essentially to convert (multiplex) the 8-bit data to 24-bit data, depending upon system or specification requirements. In a preferred embodiment, the present invention utilizes an 8-bit microcomputer for control purposes. Therefore, the microprocessor interface 80 provides the necessary conversion of the 8-bit to 24-bit data. The 24-bit data bus is bidirectional for connection to the address generator 90 of FIG. 2.

In FIG. 2, the address generator 90 receives the sound data information on bus 82. Address generator 90, for purposes of describing the operation of the present invention, provides address generation signals according the improved aspects of the present invention. The particular type of sound data information, such as the particular sound to be generated whether a piano sound, violin sound or any other type of sound, is not critical to the understanding to the aspects of the present invention.

Address generator 90 generates a large address signal (e.g., 19 bits) on bus 52. The signal on bus 52 at any incident in time represents the address of a particular data sample in sound memory 60, which is to be fetched or accessed.

Address generator 90 also outputs a series of carry bits on bus 96, for the reason that the present invention is accessing differential data on bus 54 from sound memory 60. The present invention therefore must "know" when the differential data needs to be added into the data stream. Hence, a serial data stream on bus 96 is input to a data decoder 100.

Data decoder 100 also is connected to sound memory 60 via 8-bit bus 54 to receive accessed data from sound memory 60.

Data decoder decodes the accessed data in a logarithmic format to a 16-bit linear format on bus 104. The multichannel output on bus 104 could be utilized in various approaches, such as eight channels of two particular sounds. As an example, the output on bus 104 could be one combined 16-channel output or could be eight dual outputs.

Figure 3:
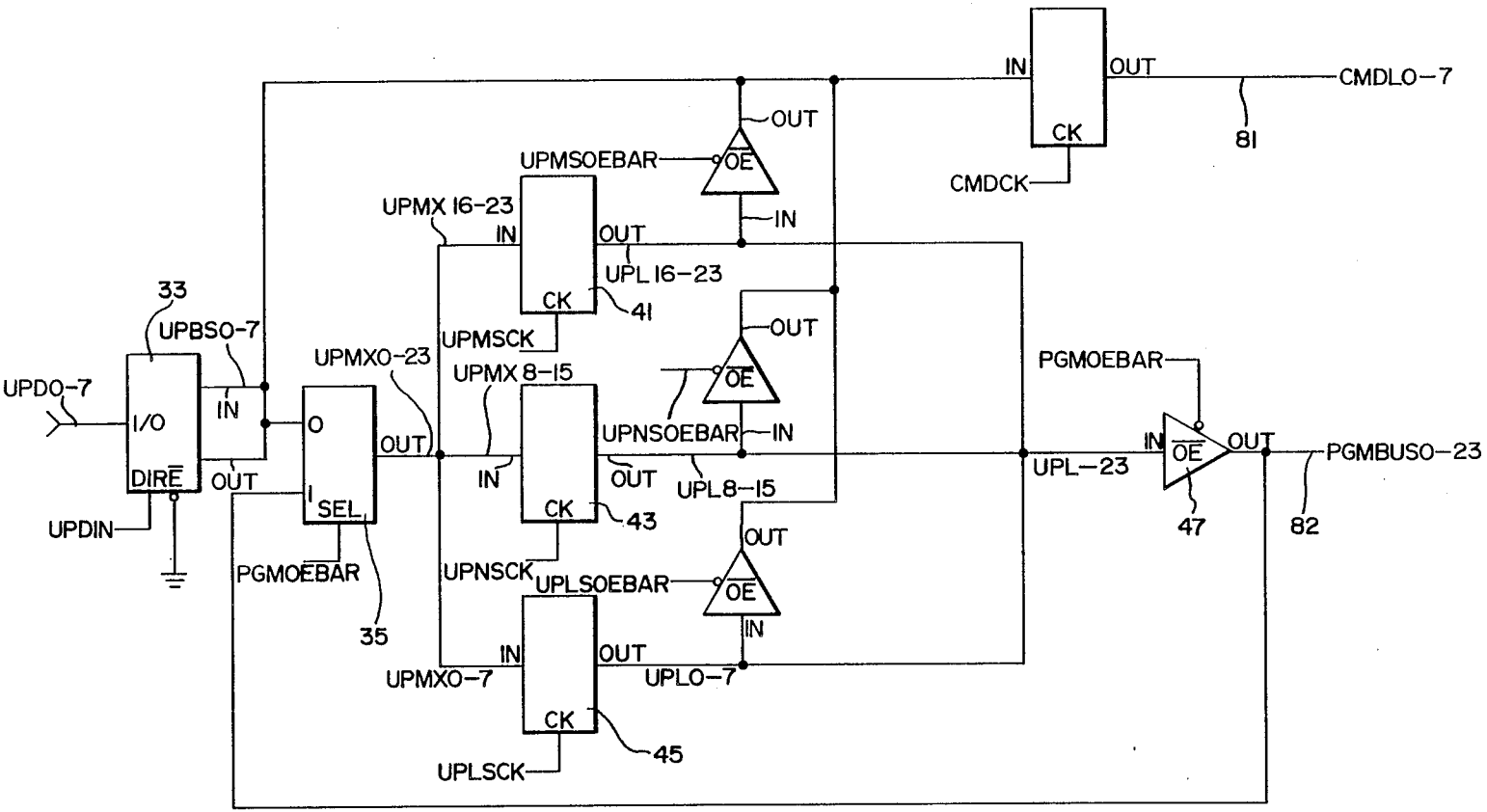
FIG. 3 depicts a block diagram of a microprocessor interface, which forms a portion of FIG. 2.

Referring to FIG. 3, the microcomputer interface 80 of FIG. 2 is depicted in which the 8-bit data is input to latch 33. The purpose of the interface circuit 80 depicted in FIG. 3 is to convert the 8-bit data input to latch 33 to a 24-bit data bus 82 for input to the address generator 90 of FIG. 2. Also, interface 80 provides an 8-bit command or control bus 81 for connection to the components depicted in FIG. 2.

The interface 80 of FIG. 13 includes a multiplexer 35 connected to latch 33. The output of multiplexer 35 is connected to latches 41, 43, 45 which can be sequentially written or read by appropriate control signals. The output of latches 41, 43, 45 are then successively enabled through gate 47 to 24-bit bus 92.

Figure 4:
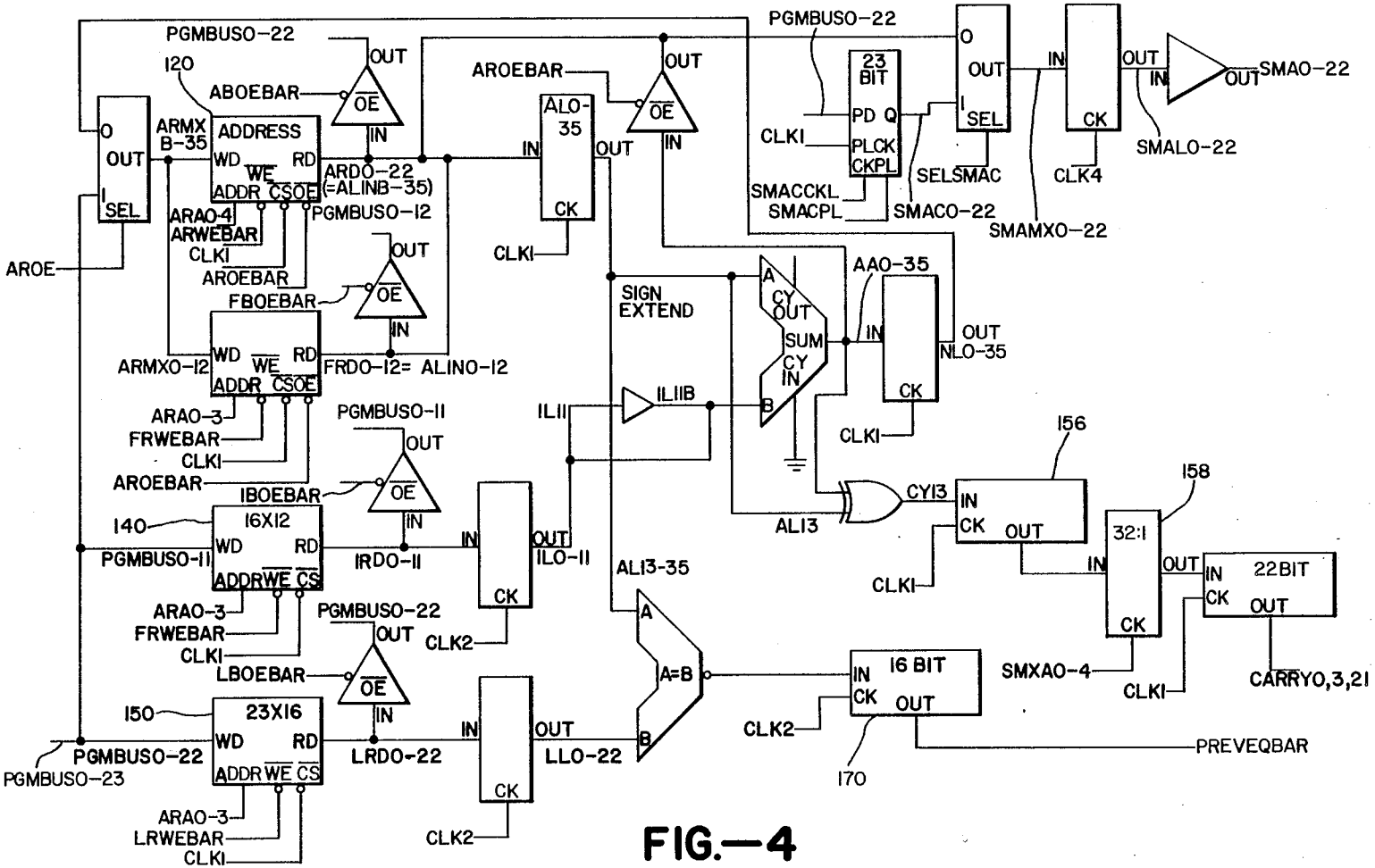
FIG. 4 depicts a block diagram of an address generator, which forms a portion of FIG. 2.

Referring now to FIG. 4, the address generation circuit 90 of FIG. 2 is shown in more detail.

The address generation circuit 90 includes four memories, which are identified as address memory 120, fraction memory 130, increment memory 140 and last memory 150.

The address memory 120 contains pointers to both the current and a reload or original address. This is for looping situations for a sound such that the current addresss points to where one currently is in the particular sound and the loop pointer points to where the sound would begin for looping o beginning the desired sound again.

The fraction memory 130 refers to the non-integer or oversampled part of the address.

The increment memory 140 determines the pitch of the particular sound. The increment address data is to be added to the old address for each oversampled cycle. The increment memory thus is a small fraction of the overall address. The greater fraction of address that the increment address forms, the faster one steps through the sound and the higher the pitch, as previously described.

The last memory 150 corresponds to the last portion of the address. When the current address matches the last address, it means that the initial address should be loaded again.

The address generator circuit 90 includes pipeline architecture means for doubly incrementing the contents of the address and fraction memories 120, 130 to enable a single cycle of operation for incrementing the addresses. In the prior art, a fetch and store operation was required which could not be done in a single memory clock cycle, except for utilizing a simultaneous read/write memory, which is quite expensive.

The address generator 90 includes double incrementable means and temporary latches to hold the data for looping back to the memories 120, 130. The fetches and stores can be completely overlapped by the incrementing so that an increment and a fetch store can be achieved in a single memory clock cycle.

The address generator includes a 32-bit shift register 156 to exit from the pipeline architecture in conjunction with a 32:1 multiplexer 158.

As an example of operation, consider multiple channels where the address of channels 0, 0′, 1, 1′, 2, 2′ (where the prime indicates the second incrementing) are input to the 32-bit shift register 156. With appropriate controls, the output of the multiplexer 158 is 0, 1, 2 . . . 15, 0′, 1′, 2′ . . . It can thus be seen that the pipeline architecture has been exited.

The 16-bit equal shift register 170 of the address generator 90 is provided to indicate when the next channel is occurring in a multichannel format.

The present invention is in effect oversampling at a 4:1 ratio, or a 4 to 1 interleaving effect. The address for a particular channel is changed every fourth cycle. Hence, for example, channel 0's address will be output for four cycles.

Figure 5:
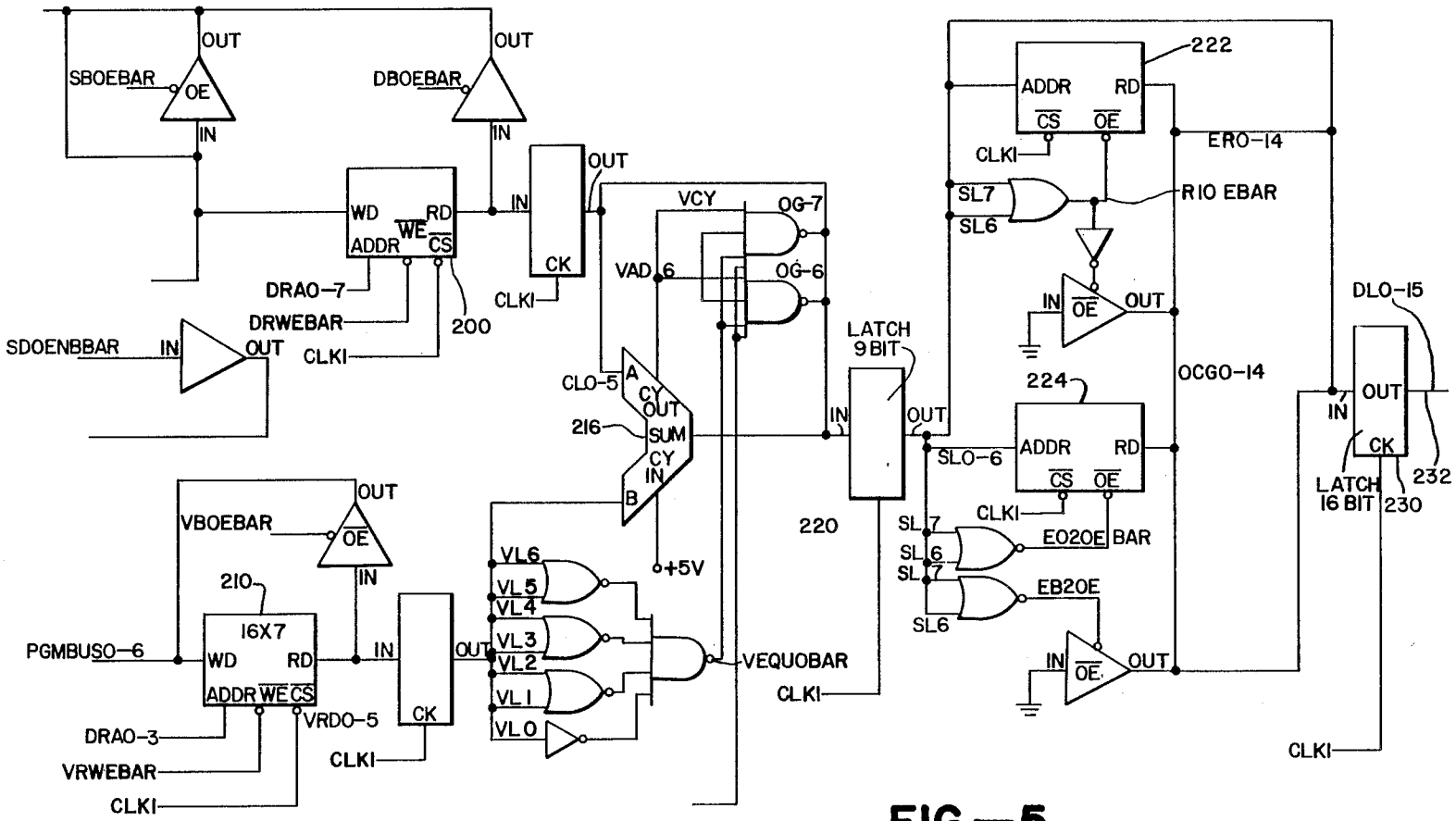
FIGS. 5 and 6 depict block diagrams of the data decoder, which forms a portion of FIG. 2.
Figure 6:
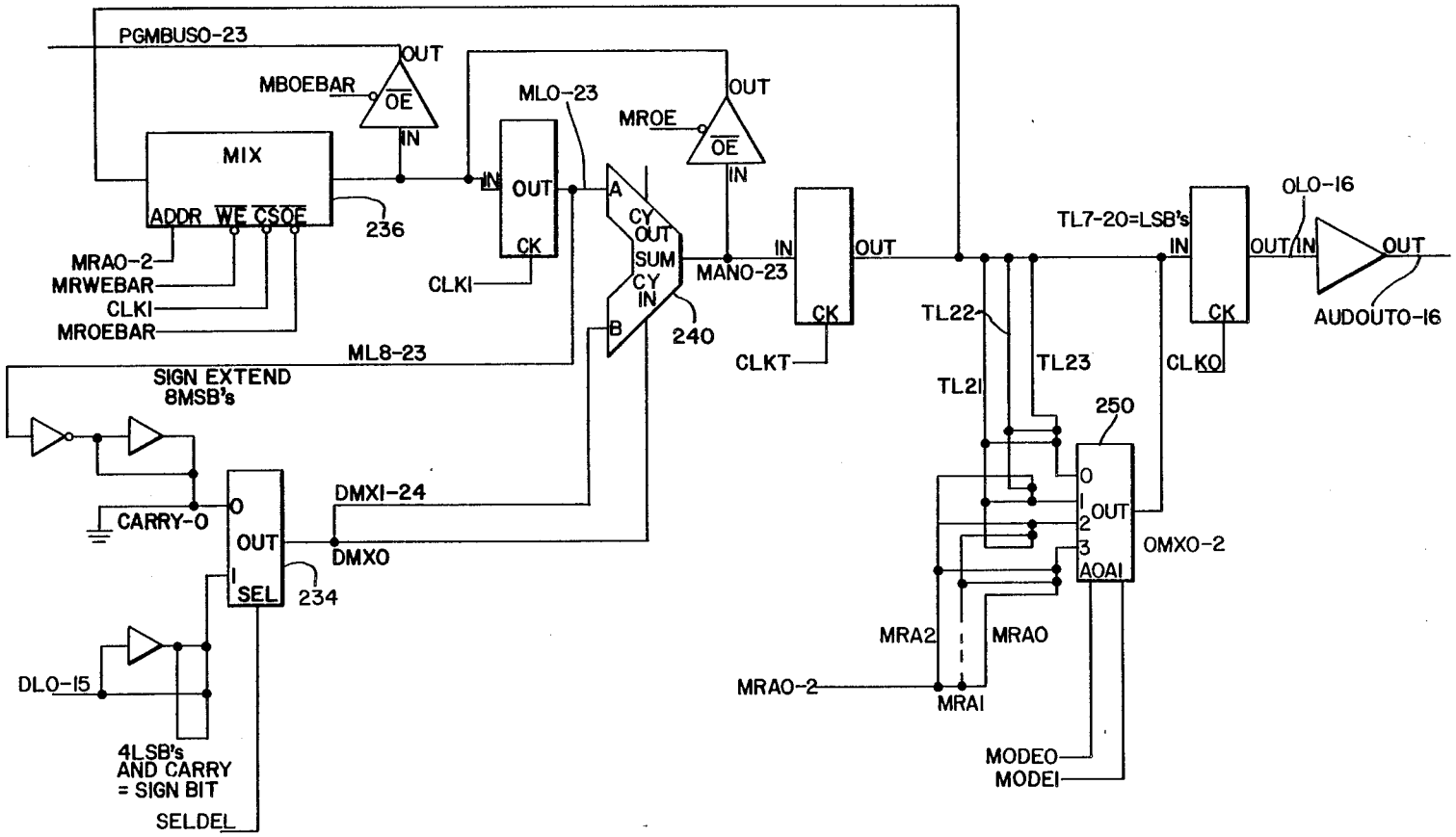

Referring now to FIGS. 5 and 6, the data decoder 100 of FIG. 2 is shown in more detail. The data decoder 100 includes a sound data RAM 200 and a volume data RAM 210. The sound data RAM 200 is a cache RAM memory which takes the data accessed from the sound memory 60 of FIG. 2 and stores that accessed data on a single cycle basis, as indicated by the series of carries coming from the address generator of FIG. 2.

The volume memory 210 of FIG. 5 contains the logarithmic number data to be added to the logarithmically coded data in the sample or sound RAM 200 in order to volume scale the sound data for any particular channel.

The respective contents of memories 200, 210 are added in a summing logic circuit, generally indicated by numeral 216, to generate a combined logarithmic signal. This signal is latched to latch 220 to be used as a lookup in memories 222, 224 (which could also be characterized as a single read only memory).

The output of memories 222, 224 are complemented in order to recombine the sign bit to provide AC information. The data from memories 222, 224 is now in a linear format and output from latch 230 on bus 232 (the output is the linear difference, as previously described).

Referring to FIG. 6, the linear difference signal on bus 232 is input through a selector 234 to a summer/accumulator, generally indicated by numeral 240.

Accumulator 240 combines the linear difference signal on bus 232 with existing information. If operating in a single channel mode, accumulator 224 is simply used to accumulate the data in a looping fashion.

Also, in order to get the signal to decay back to zero, a multiplication is performed generally to provide an exponential feedback back to zero. Because the operation of the present invention is oversampled, a given channel never has a valid difference immediately followed by another valid difference. Hence, the second cycle can be used to add in the feedback term to decay back to zero.

For multiple channels of operation, a mix RAM 236 is included which remembers the individual channels (which, in a preferred embodiment, is eight channels).

Multiplexer 250 provides an indication of which audio channel is being output at a particular time.

What is claimed is:

1. A digital sampling keyboard instrument for encoding digital data samples having a certain number of bits representative of a particular musical sound having a first fidelity comprising:

means for creating differences between successive ones of said digital data samples, means for creating the logarithm of said differences to form compressed logarithmic differential data which is compressed to a fewer number of bits than said certain number of bits, means for storing said compressed logarithmic differential data, means for adding time varying logarithmic encoded volume coefficients to said stored compressed logarithmic differential data to form added compressed logarithmic differential data, means for creating the anti-logarithm of said added compressed logarithmic differential data, and means for creating volumes called data samples from said anti-logarithm which approximate said digital data samples while maintaining fidelity similar to said first fidelity.

* * * * *